US011583118B1

(12) United States Patent
Ko

(10) Patent No.: US 11,583,118 B1
(45) Date of Patent: Feb. 21, 2023

(54) DRINKING VESSEL WITH ICE CUBE RETAINERS

(71) Applicant: Oliver Ko, Glendale, AZ (US)

(72) Inventor: Oliver Ko, Glendale, AZ (US)

( * ) Notice: Subject to any disclaimer, the term of this patent is extended or adjusted under 35 U.S.C. 154(b) by 0 days.

(21) Appl. No.: 17/480,514

(22) Filed: Sep. 21, 2021

(51) Int. Cl.
*A47G 19/22* (2006.01)

(52) U.S. Cl.
CPC ..... *A47G 19/2205* (2013.01)

(58) Field of Classification Search
CPC ..... A47G 19/2205
USPC ..... 220/660
See application file for complete search history.

(56) References Cited

U.S. PATENT DOCUMENTS 3,666,110 A * 5/1972 Hodges ..... C03B 11/10 210/469
3,785,794 A * 1/1974 Hodges ..... C03B 23/002 65/282
3,934,725 A * 1/1976 Edwards ..... B65D 1/265 206/520
2009/0277812 A1* 11/2009 Driscoll ..... B65D 81/3865 220/592.2
2010/0264107 A1* 10/2010 Lonsway ..... C03B 9/325 65/78
2011/0095038 A1* 4/2011 Williams, Jr. ..... A47G 19/2211 220/703
2011/0309092 A1* 12/2011 Gatta ..... A47G 19/2205 220/703
2014/0023767 A1* 1/2014 Dikas ..... B01F 23/2362 29/469
2015/0203235 A1* 7/2015 Laib ..... C03B 9/32 215/40
2020/0008597 A1* 1/2020 Tuominen ..... A47G 19/2205

FOREIGN PATENT DOCUMENTS

FR 417244 A * 6/1910 ..... C03B 11/06
GB 1441771 A * 7/1976 ..... C03B 9/33
JP 2002125826 A * 5/2002 ..... A47G 19/00

* cited by examiner

*Primary Examiner* — Jennifer Robertson
*Assistant Examiner* — Eric C Baldrighi
(74) *Attorney, Agent, or Firm* — Bruce A. Lev

(57) ABSTRACT

A drinking vessel that includes a plurality of spaced protrusions permanently attached to and extending inwardly from a position spaced from the top rim of the drinking vessel and that are adapted to allow liquids to pass thereby and out of the interior volume of the drinking vessel and at the same time block ice cubes from passing thereby and out of the interior volume, such that a user can drink the liquid without having ice cubes enter their mouth as well.

7 Claims, 4 Drawing Sheets

DRINKING VESSEL WITH ICE CUBE RETAINERS

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to drinking vessels, and more specifically to drinking vessels including a means to retain ice cubes therein.

2. Description of the Related Art

Prior art drinking vessels rely on a separate ice retaining apparatuses that are attachable at or near the top rim of the drinking vessel. The problem becomes finding an apparatus for retaining or blocking ice cubes when needed and then hoping it is attachable to the drinking vessel being used. Furthermore, the prior art apparatuses need to be attached on or so close to the rim of the drinking vessel that they impedes the user's ability to place their mouth along the rim to drink liquids therefrom comfortably and/or unimpeded.

Accordingly, the present invention overcomes the disadvantages associated with the prior art, by providing a drinking vessel that includes a plurality of spaced protrusions permanently attached to and extending inwardly from a position spaced from the top rim of the drinking vessel and that are adapted to allow liquids to pass thereby and out of the interior volume of the drinking vessel and at the same time block ice cubes from passing thereby and out of the interior volume, such that a user can drink the liquid without having ice cubes enter their mouth as well.

BRIEF SUMMARY OF THE INVENTION

In view of the foregoing disadvantages inherent in the known types of drinking vessels and ice retainers or blockers or the like in the prior art, the present invention provides a drinking vessel that includes a plurality of ice cube retaining spaced protrusions permanently attached to and extending inwardly from a position spaced from the top rim of the drinking vessel. As such, the general purpose of the present invention, which will be described subsequently in greater detail, is to provide a drinking vessel that includes a plurality of ice cube retaining spaced protrusions with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

Figure 1:
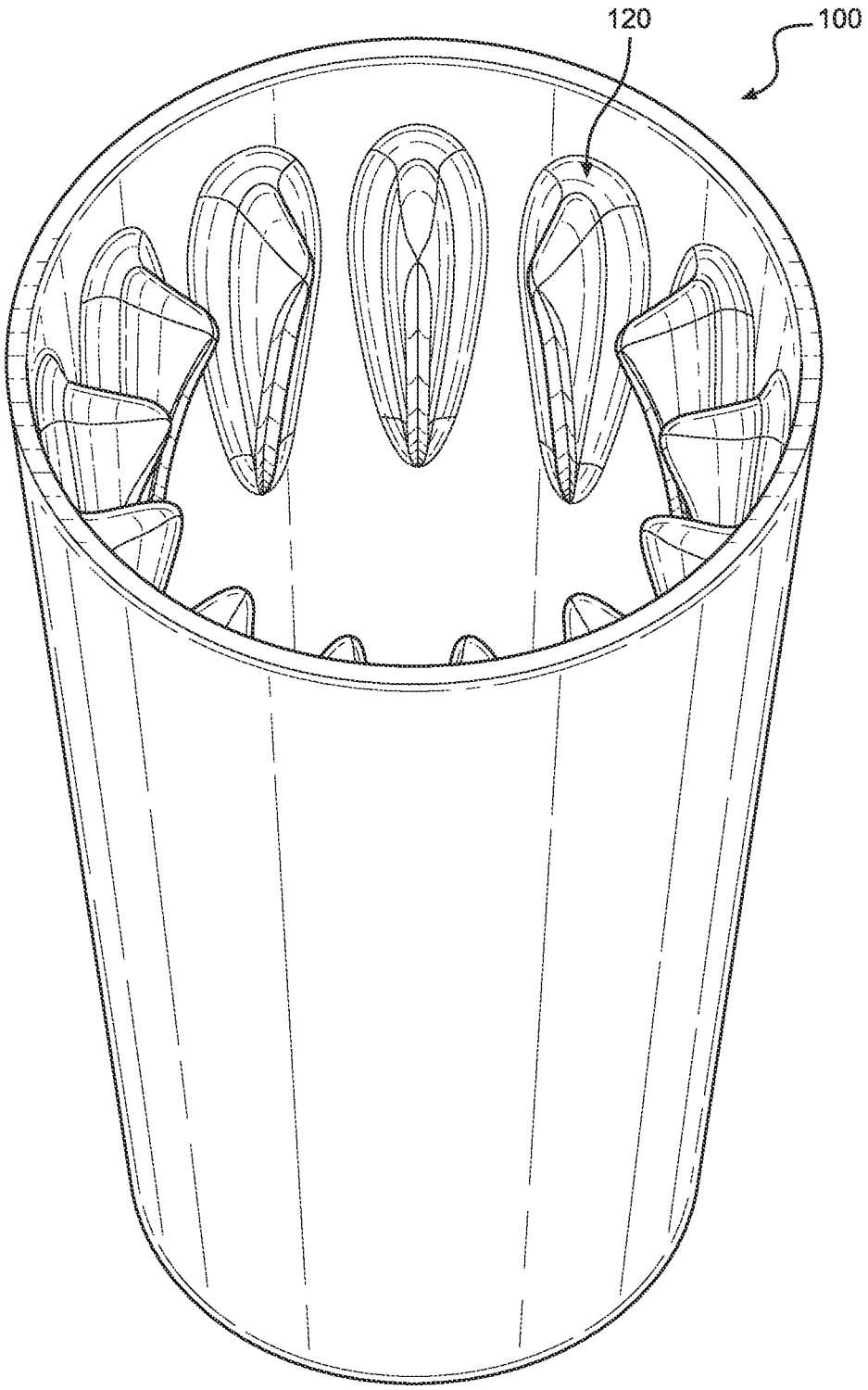
FIG. 1 shows a perspective view of the drinking vessel with ice cube retainers according to the preferred embodiment of the present invention.
Figure 2:
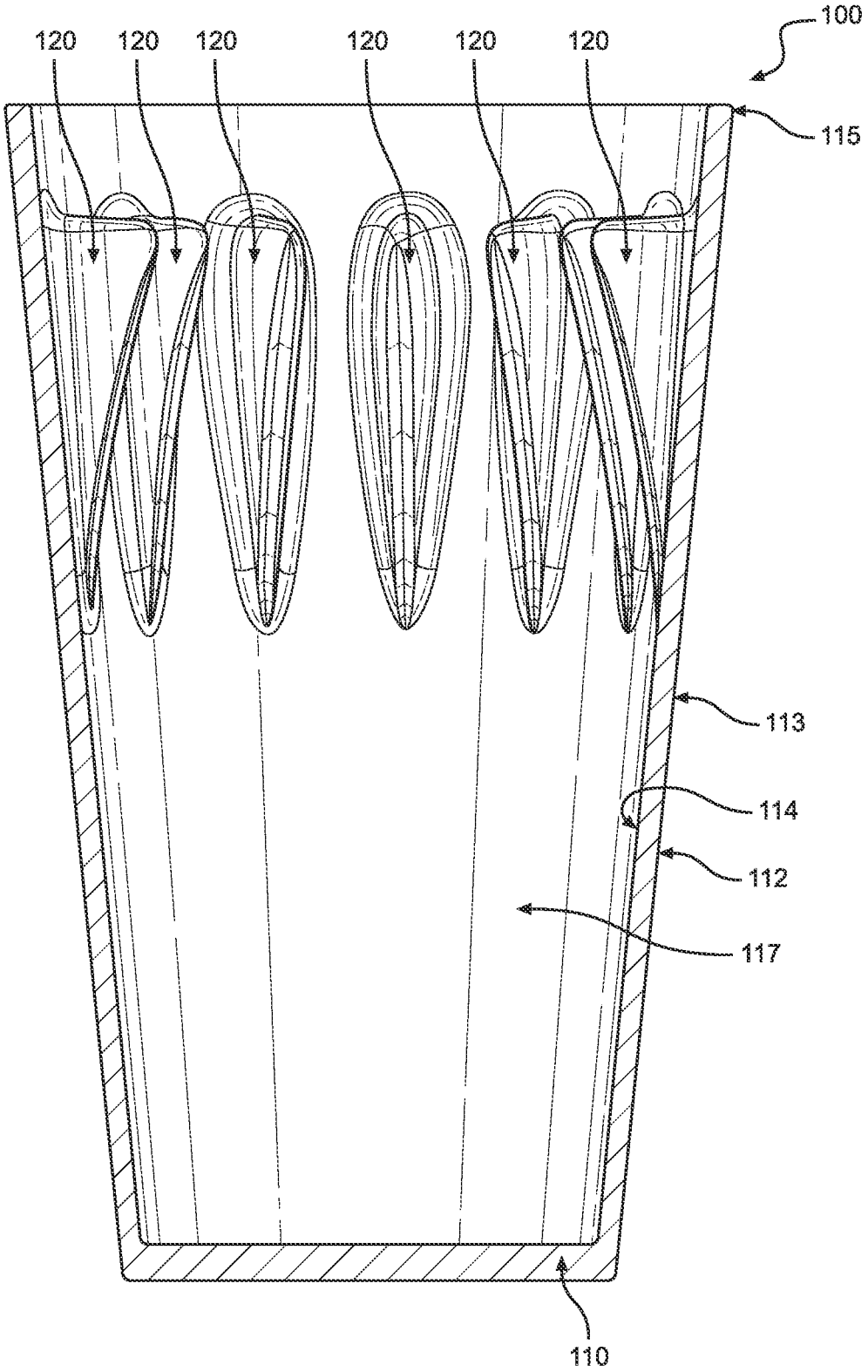
FIG. 2 shows a side cutaway view of the drinking vessel with ice cube retainers according to the preferred embodiment of the present invention of FIG. 1.
Figure 3:
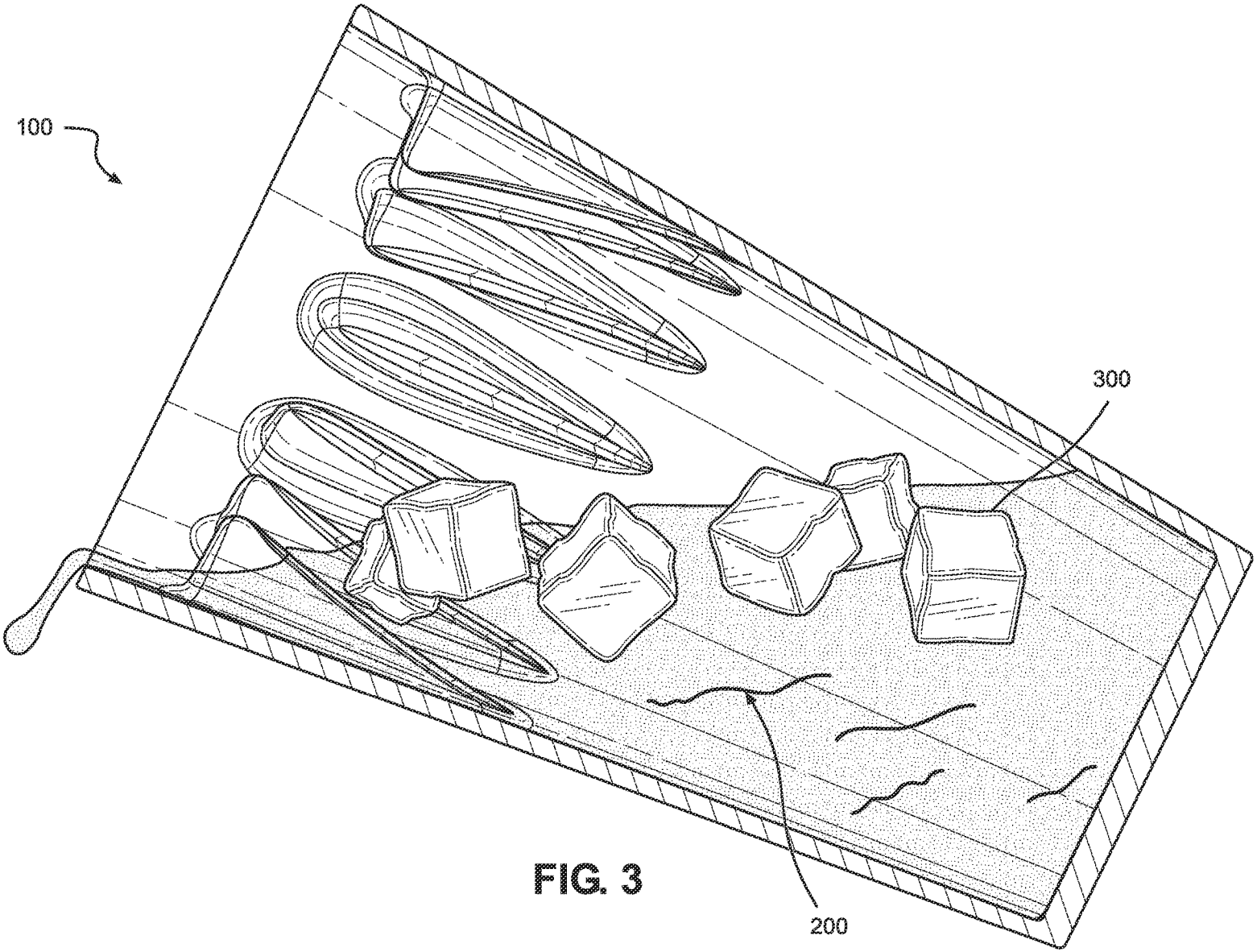
FIG. 3 shows a side cutaway view of the drinking vessel with ice cube retainers in-use according to the preferred embodiment of the present invention of FIG. 1.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Turning now descriptively to drawing, referring to FIGS. 1-4, the present invention discloses a drinking vessel 100 comprising a bottom wall 110 adapted to stabily retain the drinking vessel upon a supporting surface, at least one side wall 112 including an outer surface 113, an inner surface 114, and a top rim 115, wherein the at least one side wall is connected to the bottom wall and extends upwardly therefrom, and wherein the at least one side wall and the bottom wall form an interior volume 117 adapted to retain a liquid 200 and ice cubes 300 therein; and a plurality of protrusions

120 located in proximity to the top rim 115, wherein the plurality of protrusions 120 are connected to the inner surface 114 of the at least one side wall 112 and extend into the interior volume 117, wherein the plurality of protrusions 120 are spaced from one another, and wherein the plurality of protrusions 120 are adapted to allow the liquid to pass thereby and out of the interior volume, and block the ice cubes from passing thereby and out of the interior volume, such that a user can drink the liquid without having ice cubes enter their mouth as well.

In the preferred embodiment, the plurality of protrusions 120 are evenly spaced from one another. Furthermore, each of the plurality of protrusions 120 include a connecting surface 122 including a top portion 124 located in proximity to said top rim, and a bottom portion 125 located downwardly from the top portion and towards the bottom wall, wherein the connecting surface 122 is connected to the inner surface 114 of the at least one side wall 112; and a contact surface 126, that is adapted to contact the liquid 200 and ice 300 inside the interior volume of the vessel, that includes a top portion 127 connected to the top portion 124 of the connecting surface and extends therefrom, a bottom portion 128 connected to the bottom portion 125 of the connecting surface and extends therefrom, and an apex 129 located in between the top portion 127 and the bottom portion 128, wherein the contact surface 126 extends into the interior volume and is adapted to contact the liquid and ice cubes when within the drinking vessel, and wherein the apex 129 extends into the interior volume further than the top portion and bottom portion of the contact surface. This particular shape is adapted to contact the ice cubes 300 and retain them with the interior volume of the drinking vessel while the liquid 200 passes thereby and out of the interior volume of the drinking vessel 100 and into the mouth of a user.

Figure 4:
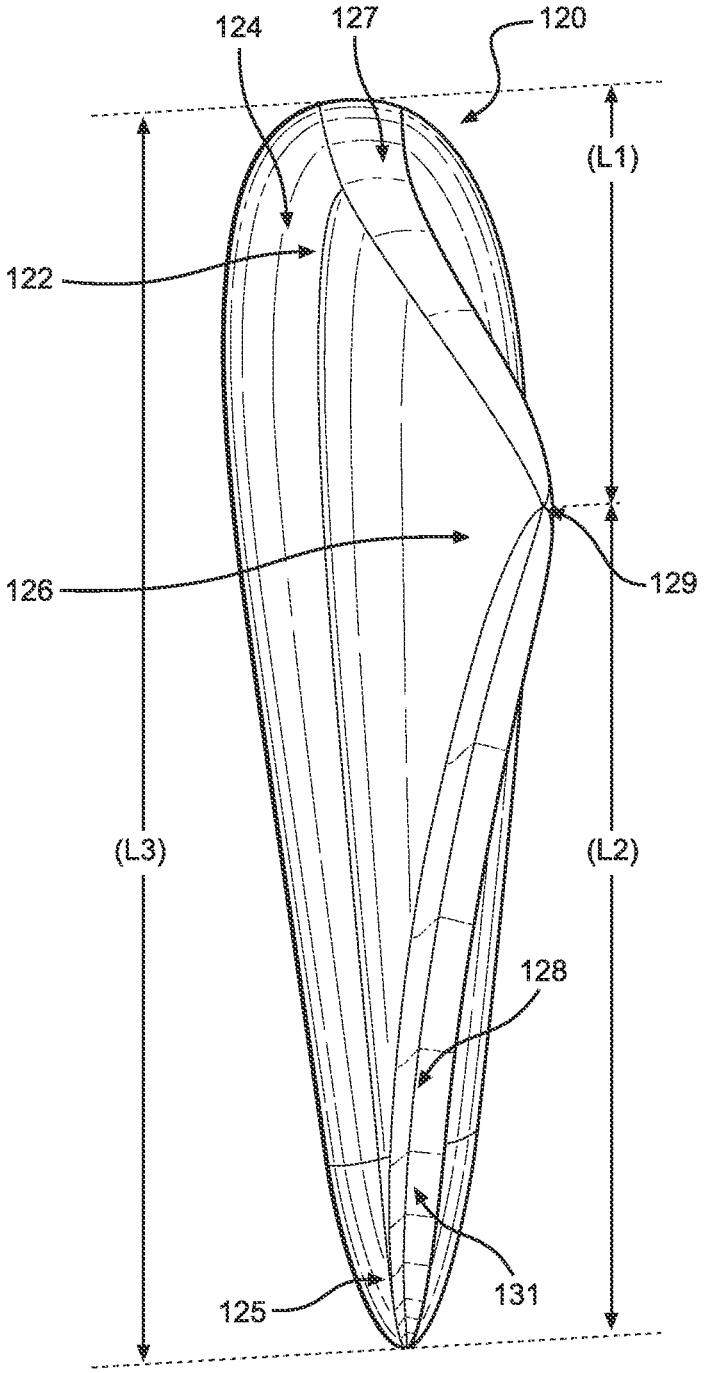
FIG. 4 shows a perspective view of an ice cube retainer according to the preferred embodiment of the present invention of FIG. 1.

In the preferred embodiment, as shown in FIG. 4, the bottom portion 128 of the contact surface 126 has a length (L2) that is larger than the length (L1) of the top portion 127 of the contact surface 126. In more detail, the distance between the apex 129 of the contact surface 126 and the connecting surface 122 may be approximately ½ of an inch. Furthermore, the bottom portion 128 of the contact surface 126 may also include an inwardly curved surface 131, the connecting surface 126 may be formed having an oblong shape, and the contact surface 126 may be formed having an oblong cross-section. Furthermore, the distance between each of the plurality of protrusions 120 may be approximately ⅓ of an inch, and the width of each the plurality of protrusions 120 may be approximately ⅓ of an inch. Furthermore, the length (L3) of each of the plurality of protrusions 120 may be approximately 2 inches. These shapes and dimensions increase the ability and efficiency of the protrusions to block/retain the ice cubes within the interior volume of the drinking vessel while the liquid passes thereby and out of the interior volume of the drinking vessel and into the mouth of a user.

The drinking vessel may be formed from a material chosen from a list of materials consisting of plastic, glass, and metal, however, other materials may be used depending on the requirements of the user.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A drinking vessel comprising:

a bottom wall;

wherein said bottom wall is adapted to stably retain said drinking vessel upon a supporting surface; and wherein said bottom wall has a circular shape defining a radius;

at least one side wall including:

an outer surface;

an inner surface; and a top rim;

wherein said top rim has a circular shape defining a radius; and wherein said radius of said top rim is at least as large as said radius of bottom wall;

wherein said at least one side wall is connected to said bottom wall and extends upwardly therefrom; and wherein said at least one side wall and said bottom wall form an interior volume adapted to retain a liquid and ice cubes therein; and a plurality of protrusions:

wherein said plurality of protrusions are located in proximity to said top rim;

wherein said plurality of protrusions are connected to said inner surface of said at least one side wall and extend into said interior volume;

wherein said plurality of protrusions are spaced from one another; and wherein said plurality of protrusions are adapted to allow said liquid to pass thereby and out of said interior volume, and block said ice cubes from passing thereby and out of said interior volume, such that a user can drink said liquid without having ice cubes enter their mouth as well;

wherein each of said plurality of protrusions include:

a connecting surface including:

a top portion;

wherein said top portion is located in proximity to said top rim; and a bottom portion;

wherein said bottom portion is located downwardly from said top portion and towards said bottom wall;

wherein said connecting surface is connected to said inner surface of said at least one side wall; and a contact surface including:

a top portion;

wherein said top portion is connected to said top portion of said connecting surface and extends therefrom;

a bottom portion;

wherein said bottom portion is connected to said bottom portion of said connecting surface and extends therefrom; and an apex:

wherein said apex is located in between said top portion and said bottom portion;

wherein said contact surface extends into said interior volume and is adapted to contact said liquid and ice cubes when within said drinking vessel; and wherein said apex extends into said interior volume further than said top portion and bottom portion of said contact surface;

wherein said bottom portion of said contact surface has a length that is larger than the length of said top portion of said contact surface; and wherein said bottom portion of said contact surface includes two curved walls each curving toward the connecting surface, wherein both converge with each other to form a curved ridgeline divot that extends from the apex to the bottommost point of the contact surface.

2. The drinking vessel of claim 1, wherein said wherein said a plurality of protrusions are evenly spaced from one another.

3. The drinking vessel of claim 1, wherein the distance between said apex of said contact surface and said connecting surface is ½ of an inch.

4. The drinking vessel of claim 1, wherein said connecting surface is formed having an oblong shape; and said contact surface is formed having an oblong cross-section.

5. The drinking vessel of claim 2, wherein the distance between each said plurality of protrusions is ⅓ of an inch; and wherein the width of each said plurality of protrusions is ⅓ of an inch.

6. The drinking vessel of claim 1, wherein the length of each said plurality of protrusions is 2 inches.

7. The drinking vessel of claim 1, wherein said drinking vessel is formed from a material chosen from a list of materials consisting of plastic, glass, and metal.

* * * * *